United States Patent [19]

Perrin

[11] 3,963,156

[45] June 15, 1976

[54] GUN REST CRADLE

[76] Inventor: Frederick W. Perrin, 6161 Engleman, Warren, Mich. 48091

[22] Filed: Apr. 1, 1974

[21] Appl. No.: 457,104

[52] U.S. Cl. ..... 224/1 R; 224/5 R; 248/224

[51] Int. Cl.[2] ..... F41C 33/00

[58] Field of Search ..... 224/1 R, 26 R, 2 A, 224/1 A, 26 B, 42.45 R, 42.46 R; 248/231, 221, 224

[56] References Cited

UNITED STATES PATENTS

| | | | |
|---|---|---|---|
| 1,156,370 | 10/1915 | Pomeroy | 224/42.46 R |
| 1,469,285 | 10/1923 | Thompson | 224/1 R |
| 3,022,898 | 2/1962 | Loeb | 248/231 X |
| 3,704,000 | 11/1972 | Nelson | 248/224 X |
| 3,749,294 | 7/1973 | Johnston | 248/224 X |

*Primary Examiner*—Robert J. Spar
*Assistant Examiner*—Jerold M. Forsberg
*Attorney, Agent, or Firm*—Gifford, Chandler & Sheridan

[57] ABSTRACT

A gun rest cradle for wearing about the waist of a person, and which comprises a rectangular rigid ventral plate member and a pliable dorsal strap attached to the ends of the plate member, at least one of the attachment means between the strap and the plate member consisting of detachable means such as a buckle. The plate member is provided with a pair of removable U-shaped hook members into which the stock of a gun is engaged for hand-off support of the gun.

1 Claim, 5 Drawing Figures

GUN REST CRADLE

BACKGROUND OF THE INVENTION

The present invention relates to a gun rest cradle, or gun carrier, by which a rifle or a shotgun, as is generally used by a sportsman or a hunter, may be supported from the waist of the user, thus leaving his hands free.

It is an inconvenience, while hunting for example, to continuously carry by hand a relatively heavy and cumbersome firearm such as a shotgun or rifle, while the gun is not in use. It is consequently a common practice for hunters to lay their gun on the ground or to lean it against a tree. Such practices may not only damage the gun, but may also result in accidents caused by unintentional firing of the gun. The present invention, by providing a gun support means in the form of a gun rest cradle worn by a person about the waist, by which a gun may be supported at all times off the ground and without the use of the hands, provides the multiple advantages of freeing the hands of the user, giving fast and easy access to the gun at all times, allowing the user to stand up, sit down, or even move about with the gun remaining at all times within easy and quick access. The present invention, in addition to increasing the comfort of the user, presents the added advantage of increased safety in the use of firearms.

SUMMARY OF THE INVENTION

The principal object of the present invention is to provide means for the hand-free support and carry of a gun, such as a shotgun or a rifle, by way of a belt-like gun rest cradle providing safe and convenient support of the gun at the waist of the user, which is adaptable to use by a left-handed as well as a right-handed person and which, when not in use, may be easily stored or alternatively continuously worn by the user, as he chooses.

The many objects and advantages of the present invention will become apparent to those skilled in the art when the best mode contemplated for practicing the invention is read in conjunction with the accompanying drawing wherein:

DETAILED DESCRIPTION OF THE PREFERRED EMBODIMENT

Figure 2:
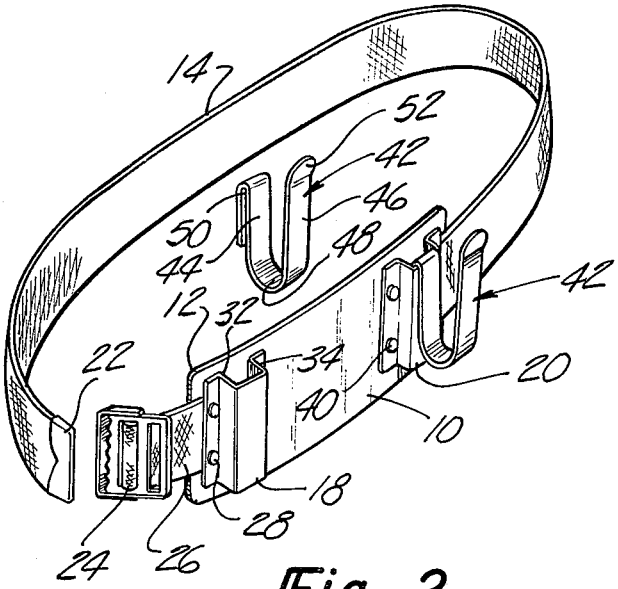
FIG. 2 is a perspective view of the gun rest cradle of the invention.
Figure 3:
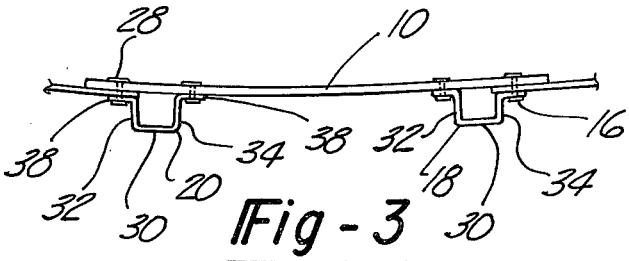
FIG. 3 is a top view of a portion thereof.
Figure 5:
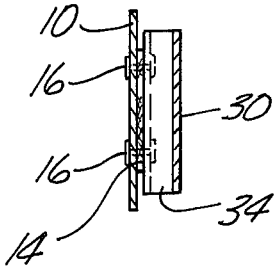
FIG. 5 is a sectional view from line 5—5 of FIG. 4.
Figure 4:
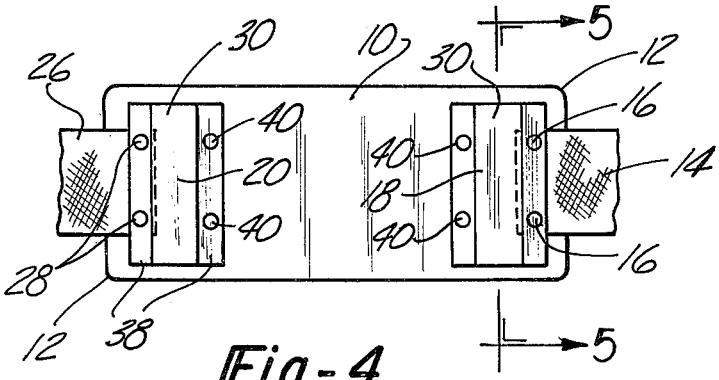
FIG. 4 is a front elevation view of the portion illustrated at FIG. 3.

Referring to the drawing in detail, a gun rest cradle according to the present invention comprises a rigid central plate member 10, made of a relatively thin but substantially rigid material such as thin sheet steel, aluminum, or preferably fiberglass. The plate member 10 is rectangular, with rounded corners as shown at 12, and is slightly bowed or curved, as best shown at FIGS. 2 and 3, to conform generally to the convex curvature of the abdomen of a wearer. A pliable dorsal strap 14, made of any conventional material such as natural or artificial leather, woven fabric, and the like, has an end fastened to an end of the plate member 10 and a free end for removable attachment to the other end of the plate member. In the example of structure illustrated, as best shown at FIGS. 3 and 4, one end of the strap 14 is attached to the plate member 10 by means of a pair of rivets 16—16 which are also used to fasten to the front surface of the plate member 10 one side of one of a pair of gusset members 18 and 20, such as gusset member 20. The free end of the strap 14 is provided with a reinforcing tapered leading edge piece 22 for facilitating the introduction of the free end of the strap between the clamping jaws of a buckle 24, FIG. 2, in turn attached to the other end of the plate member 10 by means of a short strap 26 having its end riveted to the end of the plate member 10 by means of rivets 28—28, also used for mounting on the plate member 10, proximate the same end thereof, one side of the second gusset member 18.

The gusset members 18 and 20 are each generally shaped as a U-shaped channel provided with a substantially flat bottom portion 30 and a pair of substantially parallel integral sidewall portions 32 and 34. Each sidewall is provided with an outwardly bent flange portion, shown respectively at 36 and 38, provided with appropriate holes for the passage of respectively the rivets 28—28 and 40—40, and 16—16 and 40—40, corresponding aligned holes being disposed in the plate member 10, for fastening the gusset members 18 and 20 to the front surface of the plate member 10.

As best shown at FIG. 2 a pair of identical U-shaped hangers or hook members 42 are adapted for removable mounting upon the gusset members 18 and 20. Each hanger or hook member 42 consists of a relatively thin strip of metal such as steel or preferably aluminum, bent in a generally U-shaped form, thus defining a pair of parallel sidewalls 44 and 46 integrally joined by a curvilinear section 48. The sidewall 44 is provided at its free end with a 180° bent-over portion 50, the bent-over portion 50 extending substantially parallel to the sidewall 44 at a distance permitting the hanger or hook member 42 to be attached to a gusset member by slipping the bent-over portion 50 behind the bottom portion 30 of the gusset member, with the remainder of the hanger or hook member extending outwardly, and pressing down until the edge of the bottom portion 30 of the gusset member engages the junction between the sidewall 44 and the bent-over portion 50. A hanger or hook-member 42 is shown at FIG. 3 as being removed from its supporting gusset member 18, while the other hanger or hook member is shown mounted upon its support gusset member 20. The sidewall 46 of each hanger or hook member 42 has its end portion bent over outwardly at an obtuse angle so as to form a diverging section as shown at 52. In addition, the inner surface of each hanger or hook member 42 is preferably coated with soft resilient material such as, for example, a vinyl plastic or the like, to prevent marring the finish of the gun stock when a gun, as shown at FIG. 1, is supported about the waist of a person by way of the gun rest cradle of the invention, the diverging edge 52 of the outer sidewall 46 of the hangers or hook members 42 facilitating the introduction of the gunstock between the two sidewalls of each hanger or hook member 42.

Figure 1:
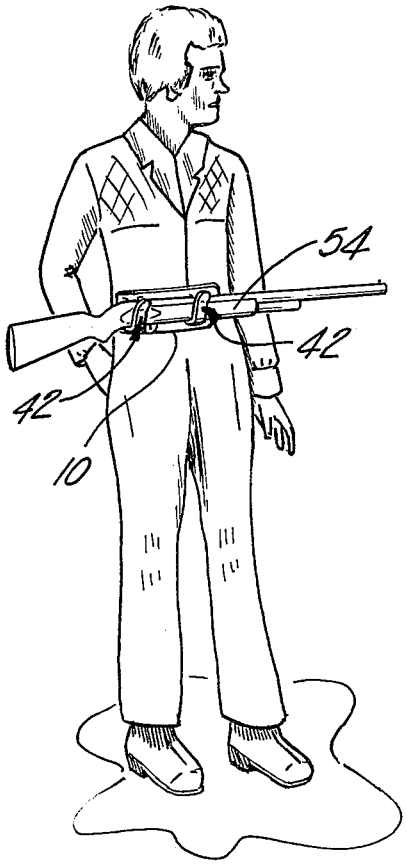
FIG. 1 is a front elevation view of the gun rest cradle of the invention worn about the waist of a person, shown in use for supporting a gun.

As can best be seen at FIG. 1, a gun 54 may thus be supported by the wearer of the gun rest cradle, off the ground and with the wearer having complete freedom of his hands. As illustrated at FIG. 1, the gun 54 is supported in a manner which is convenient for a right-handed hunter or sportsman. A left-handed hunter or sportsman would normally wear the gun rest cradle of the invention in the same manner, but with the gun supported such that its muzzle is towards the left, rather than towards the right as illustrated. The gun rest cradle may be attached about the waist of the wearer with the buckle 24 placed on the right, or with the buckle on the left, the plate member 10 being in all cases disposed in a ventral position, and the hangers or hook members 42 each being removably mounted upon a gusset member 18 or 20 in an appropriate vertical position permitting the stock of the gun 54 to be nested within the U-shaped hangers or hook members 42.

It will be appreciated that, if so desired, a buckle may be mounted on each end of the plate member 10, and that when not in use the gun rest cradle may remain about the waist of the wearer, the removable hanger or hook members 42 being then preferably stored in the wearer's pockets.

The gun rest cradle of the invention may thus be worn like an ordinary belt, and diverse paraphernalia may be suspended from it, such as knives, pickaxes and the like, either by removably attaching to the gusset members 18 and 20, to the upper edge of the plate member 10 or to the upper edge of the strap 14.

It will also be appreciated that as a result of removing the hangers or hook members 42 from the support gusset members 18 and 20 and folding the strap 14, the gun rest cradle of the invention may be easily stored in a small place such as a bag or the pockets of the user.

Having thus described the present invention by way of a typical structual embodiment thereof, what is novel and sought to be protected by United States Letters Patent is as follows:

1. A gun rest cradle adapted for support about the waist of a wearer, said cradle comprising a substantially rectangular central rigid plate member, a pliable dorsal strap, fastening means at each end of said strap, a pair of substantially U-shaped hook members, means for removably mounting said hook members on said plate member for receiving a stock of a gun in said hook members for supporting said gun at two separated engagement locations along the length of said gun stock, said detachable fastening means comprising a buckle fastened to an end of said plate member and means at the corresponding end of said strap for connection with the buckle, said means for removably mounting said hook members on said plate member comprising a pair of spaced apart gusset members affixed in substantially parallel relationship to said plate member proximate each end thereof, each of said gusset members being in the form of an elongated open U-shaped channel having a substantially flat bottom section and a pair of substantially parallel wall portions each provided with an outwardly extending flange portion for fastening to said plate member wherein one end of said dorsal strap is sandwiched between one of said flange portions and said plate member, said U-shaped hook members each being made of a substantially rigid strip of metal bent over in a generally U-shaped configuration defining a pair of spaced apart substantially parallel sidewalls joined together by a curvilinear section across one longitudinal end of each sidewall and wherein one of said sidewalls includes an integral projecting portion at its other longitudinal end bent substantially at 180° relative to said sidewall and adapted for hooking engagement over either of the open ends of said gusset members by inserting the projecting portion into the U-shaped channel of said gusset members wherein the longitudinal length of said U-shaped channel of said gusset members is at least as long as the longitudinal length of said projecting portion thereby preventing rotation of said hook members in said gusset members, whereby said hook members can be removably mounted in either end of said gusset members and whereby different sized hook members are attachable to said gusset members to accommodate different sized guns, the other sidewall of said hook members having an end portion bent at a diverging angle for facilitating the introduction of said gun stock between said sidewalls and wherein said U-shaped hook members are provided with a resilient and soft surface covering at the area in engagement with said gun stock so as to protect said gun stock when said gun is mounted in said gun rest cradle.

* * * * *